United States Patent [19]

Kowalyshyn et al.

[11] 4,239,012

[45] Dec. 16, 1980

[54] HOMING TORPEDO CONTROL APPARATUS

[75] Inventors: Stephen Kowalyshyn, Ellicott City; John C. Voorhees, Baltimore, both of Md.

[73] Assignee: The United States of America as represented by the Secretary of the Navy, Washington, D.C.

[21] Appl. No.: 76,080

[22] Filed: Dec. 15, 1960

[51] Int. Cl.[3] ..... F42B 19/01; F42B 19/06

[52] U.S. Cl. ..... 114/23; 114/21 A; 114/25

[58] Field of Search ..... 114/21, 25, 23

[56] References Cited

U.S. PATENT DOCUMENTS

| | | | |
|---|---|---|---|
| 1,892,431 | 12/1932 | Hammond | 114/21 R |
| 2,454,161 | 11/1948 | Hall | 114/23 X |
| 2,996,028 | 8/1961 | Montgomery et al. | 114/25 |
| 3,003,449 | 10/1961 | Wiebusch | 114/23 |
| 3,064,610 | 11/1962 | Montgomery | 114/23 |

*Primary Examiner*—David H. Brown

*Attorney, Agent, or Firm*—Richard S. Sciascia; Ervin F. Johnston

EXEMPLARY CLAIM

2. In an echo-ranging torpedo wherein spurious and true-target echo signals may be received in the listening periods between repetitive search-pulse transmission instants, in combination: a receiver operative to convert received echo signals to steering command signals having characteristics corresponding to echo-source direction, said receiver including a target-recognition circuit and a gating relay which operates, with inherent delay, in response to recognition of each true-target echo signal; a steering control circuit, including steering relay and switch means, adapted to place said steering relay and switch means in a condition corresponding to echo-source direction as derived by said steering control circuit, when operative, from said steering command signals; means applying said steering command signals to said steering control circuit; means controlled by operation of said gating relay, in response to each reception and recognition of a true-target echo signal, to render said steering control circuit operative to respond to steering command signals stemming from subsequent echo signals during a predetermined interval, of the order of a few listening periods, following each said reception and recognition of a true-target echo signal, and steering apparatus responsive, when rendered effective, to said steering relay and switch means condition; said gating relay, when operated, controlling said steering apparatus to render it effective to respond to said steering relay and switch means condition.

2 Claims, 1 Drawing Figure

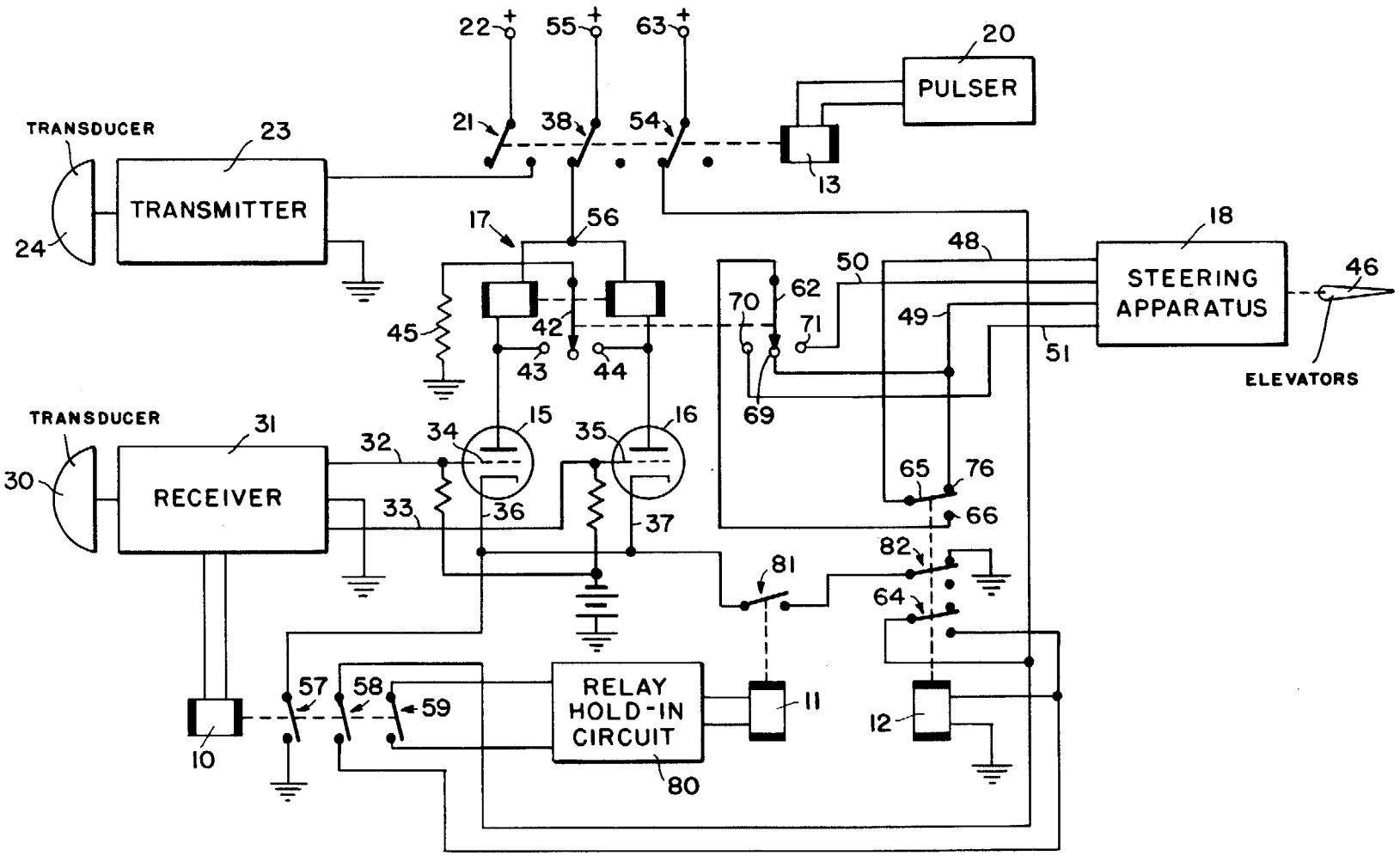
STEERING APPARATUS
ELEVATORS
PULSER
TRANSMITTER
RECEIVER
RELAY HOLD-IN CIRCUIT
TRANSDUCER
TRANSDUCER

HOMING TORPEDO CONTROL APPARATUS

The present invention relates to underwater-target detection and location apparatus, and more particularly to an improvement therein which avoids loss or perversion of target direction information due to gating-relay response delay.

The invention is directly intended for use in echo-ranging homing torpedoes which employ a target-recognition technique for the purpose of enabling steering action in response only to true target echoes. It has been found that in torpedoes of such type, employing gating relays in their target recognition circuits in prior art manner, the inherent time delay in gating relay response, even though considerably shorter than echo pulse duration, may in some instances be disadvantageous. Gating-relay response delay is ordinarily tolerated in earlier torpedo systems in that satisfactory homing action is in fact obtained under the condition of normal target echoes. However, under certain conditions which may occur during target pursuit, giving rise to target echoes which are subnormal say as to effective pulse duration, or as to variability of direction-identifying characteristics within the time-length of the echo pulse, such prior art torpedo systems may execute faulty pursuit action, attributable to operation delay of the gating relay with resultant loss of steering information carried by the earlier portion of the steering command signal pulse, or sometimes perversion of the steering information as derived by the steering control circuit. This will be better understood by considering a specific example of such a torpedo, such as that described in copending patent application Ser. No. 596,366, now U.S. Pat. No. 3,722,446, entitled "Torpedo Homing System", filed July 6, 1956 by D. A. Cooke, wherein a steering control circuit associated with steering apparatus becomes operative and responsive to a steering command signal pulse (supplied by the receiver apparatus to the steering control circuit), provided that the steering command signal pulse stems from a so-called true target echo rather than from a spurious echo. True target echoes may be so termed and determined on the basis, for example, of an echo signal exceeding say a predetermined amplitude threshold, in any event on some basis which is utilized by a target recognition circuit of the receiver to deliver a gating signal which controls a gating relay, in turn enabling the steering control circuit to become operative and responsive to the steering command signal pulse corresponding to that echo signal. In the above-described system, therefore, a steering command signal pulse is ineffective to impart steering information to the steering control circuit unless and until the gating relay operates in response to the gating signal stemming from a true target echo. The delay interposed by gating relay response time causes loss of the leading portion of the steering command signal pulse and the particular direction information carried thereby. Under the condition of a subnormal target echo which may occur during target pursuit as noted above, the remaining portion of the steering command signal pulse may be ineffective to provide proper steering information to the steering control circuit, thereby deteriorating the torpedo pursuit action.

A principal object of the present invention is to provide an underwater-target detection and location system, of the type employing a target-recognition circuit and an associated gating relay, with a novel control relay combination which prevents loss of target direction information due to gating-relay response delay.

Another object of the invention is to provide an improved echo-ranging homing torpedo system of the type employing a target-recognition circuit and an associated gating relay, in which steering action during target pursuit is not deteriorated, under subnormal target echo conditions, by inherent response delay of the gating relay.

Other objects and many of the attendant advantages of this invention will be readily appreciated as the same becomes better understood by reference to the following detailed description when considered in combination with the accompanying drawing, wherein the single FIGURE is an exemplary embodiment of the invention in a homing torpedo system shown partly in block diagram form.

In accordance with the present invention as employed in an echo-ranging homing torpedo, improved utilization of the steering command signal pulses is accomplished by provision of a relay control system which, during target acquisition, secures normal operation of the conventional gating relay, but which, after target acquisition and during the target pursuit phase, while retaining the control of the target recognition circuit and its associated gating relay over actual steering response of the torpedo, effects immediate application of each steering command signal pulse to the steering control circuit which itself correspondingly responds in correct manner to the target direction information carried by the steering command signal pulses.

Referring now to the single FIGURE, the exemplary torpedo system there shown, embodying the present invention, is basically of known type and circuitry except as to the combination of gating relay 10, acquisition hold-in relay 11, auxiliary gating relay 12 and pulsing relay 13, and the effect of these relays upon the steering control circuit comprising the so-called steering relay tubes 15, 16 and the three-position steering control relay 17, and upon the operation of the steering control apparatus 18. It will be understood that for purposes of simplification, and sufficing to impart a full understanding of the invention, the torpedo system as illustrated and described is limited to concern homing control in depth only. Each of the block-represented units may be of conventional type. Pulser 20, operated say by timing switch means therein (not shown) to energize relay 13 and to close switch 21 (and to operate its other switches) for brief periods of say 40 milliseconds or less duration, and at intervals of say 1.25 seconds, causes voltage supplied to terminal 22 to be intermittently applied to transmitter 23, resulting in the projection, by transducer 24, of underwater ultrasonic search pulses of like duration and repetition interval. Transducer 30 and receiver 31 may operate in conventional manner upon received echoes to convert them to steering command signal pulses having the same duration and repetition characteristics as the received echoes. By way of specific example, and in accordance with conventional techniques, the steering command signal pulses as provided by receiver 31 via leads 32, 33 to control grids 34, 35 may take the form of an a.c. signal of echo pulse duration and having amplitude and phase characteristics correponsing to the vertical angle deviation of target direction relative to the torpedo axis (not shown). In the instance of such type of steering command signal, steering relay tubes 15, 16 are employed as conventional phase-sensitive detectors to which receiver 31 also provides oppositely-phased reference signals via the same leads 32, 33. Provided that the cathodes 36, 37 of tubes 15, 16 are grounded through certain relay actions as will appear, and with switch 38 of relay 13 in its normally closed condition during the listening period between search pulses, the steering control circuit will react to the steering command signal pulse applied thereto, and switch arm 42 of the steering control relay 17 will accordingly move into engagement with either contact 43 or 44, dependent on whether the received echo arrives from say an up-target or a down-target, respectively. Steering control relay 17 is of standard differential coil type, as indicated, and the tubes 15, 16 are suitably biased to limit the quiescent plate and coil currents to equal and suitably low level in the absence of a steering command signal. After being moved into engagement against either contact 43 or 44, switch arm 42 is maintained in such condition until the end of the listening period, despite the pulse character of the steering command signal, by virtue of resistor 45 which completes a holding circuit. At the time when pulsing relay 13 operates to cause generation and projection of the next search pulse, normally closed switch 38 opens to break the steering control relay energization circuit, so that switch arm 42 and the switch arm 62 linked thereto are always in neutral or midposition at the beginning of each listening period.

Steering control apparatus 18 which in this instance operates torpedo depth-steering elevators 46 may itself be of conventional type, for example such as is employed in the previously mentioned copending application, wherein a servo-amplifier and other apparatus (not shown) operate to effect straight, up or down steering, dependent upon whether servo-amplifier lead 48 becomes connected to neutral lead 49, a.c. voltage lead 50 or oppositely-phased a.c. voltage lead 51 by the switching actions to be described.

Referring now to the combination of relays and the switches operated thereby, they are to be understood as illustrated in their initial condition prior to target acquisition, that is, prior to reception of the first true target echo. All relays are initially in non-energized condition, except that pulsing relay 13 is to be understood as periodically operated by pulser 20 to actuate switches 21, 38 and 54 for brief periods of say 40 milliseconds and at intervals of say 1.25 seconds as has been indicated. In the listening periods between search pulses, during which periods switch 38 remains closed, the plate voltage (supplied to terminal 55 as indicated) is communicated to junction 56 of the steering control relay coils. Gating relay 10 is to be understood as energized by action of a target-recognition circuit (not shown, forming part of conventional receiver 31), and operates (with inherent delay) to close its switches 57, 58 and 59 only when a received echo stems from a true target, and remains energized only during the brief period of the target echo. Thus, upon reception of the first true-target echo, gating relay 10 closes switch 57, grounding cathodes 36, 37 and completing the energization circuit of steering relay tubes 15 and 16, which accordingly then operate in response to the remaining portion of the steering command signal pulse to move switch arm 42 left or right into engagement with contact 43 or contact 44 depending upon up or down target direction (in depth) relative to the torpedo axis as has been explained; until the end of the listening period, switch arm 42 remains in engagement with contact 43 or 44 through holding action of resistor 45. Upon operation of gating relay 10, auxiliary gating relay 12 is energized through closed switch 58 of relay 10 by the voltage supplied to terminal 63, and remains energized by action of holding switch 64 until the end of the listening interval. Swinger contact 65 of auxiliary gating relay 12 is correspondingly maintained in downward position against contact 66 during this time, connecting servo-amplifier lead 48 to switch arm 62. Switch arm 62, engaging contact 69, 70 or 71 by action of the steering relay tubes 15, 16 in response to target direction information carried by the steering command signal pulse as already described, and so maintained for the remainder of the listening period, correspondingly connects servo-amplifier lead 48 either to neutral lead 49, a.c. voltage lead 50 or oppositely phased a.c. voltage lead 51. Steering apparatus 18 thus positions elevators 46 in accordance with the target-direction information delivered by the steering command signal pulse. When pulsing relay 13 is again energized to cause projection of the next search pulse, switch 54 opens, auxiliary gating relay 12 becomes de-energized, its swinger contact 65 returns to engagement with contact 76, and servo-amplifier lead 48 is correspondingly connected to neutral lead 49. Elevators 46 are thus in neutral position at the beginning of each listening period and are so maintained until gating relay 10 and auxiliary gating relay 12 are again operated in response to reception of a true target echo.

Also in response to operation of gating relay 10, switch 59 closes, and triggers relay hold-in circuit 80, designed to energize relay 11 for say three listening periods (about four seconds in the described embodiment). Relay hold-in circuit 80 may be entirely conventional, e.g. of the type wherein closure of switch 59 completes a charging circuit for an RC network, which network causes a vacuum tube to conduct and to energize relay 11 for the given period which is measured anew from each triggering instant. Relay 11, hereinafter termed an acquisition hold-in relay, functions to close switch 81, and to operate other switches and circuits (not shown) which effect switchover from an initial target search phase of torpedo operation to the illustrated pursuit circuitry condition. Switch 82 is in closed condition during each listening interval until operation of auxiliary gating relay 12 is actually effected following recognition of a true target echo. Since switch 81, after target acquisition, remains closed unless a true target echo is lost and not again received in three successive listening periods, cathodes 36, 37 are grounded and steering relay tubes 15, 16 stand ready, after the target has been acquired, to respond to subsequent steering command signal pulses without waiting for true target recognition operation of gating relay 10, and consequently without any loss of steering command signal information. Thus, once the target has been acquired (and unless lost for several listening periods), the steering control circuit including tubes 15, 16 and the steering relay 17 will operate to correctly position switch arms 42 and 62 in response to echo-source direction information carried by the steering command signal pulses, and the steering apparatus 18 will not become operative (in accordance with the position of switch arm 62) to deflect the torpedo from its course in depth unless and until gating relay 10 and auxiliary gating relay 12 have in fact operated in response to true-target recognition. The delay in rendering the steering apparatus 18 operative is small, and steering will thus be effected substantially from the time a true-target echo is received until projection of the next search pulse.

It will thus be apparent that the present invention provides an improved underwater-target direction-finding technique wherein derivation of target-direction information, after target acquisition, is not limited in any manner by gating relay response delay.

Obviously many modifications and variations of the present invention are possible in the light of the above teachings. It is therefore to be understood that within the scope of the appended claims the invention may be practiced otherwise than as specifically described.

We claim:

1. In an underwater-target direction-finding apparatus of echo-ranging type wherein spurious and true-target echo signals may be received in the listening periods between repetitive search-pulse transmission instants, in combination: a receiver operative to convert received echo signals to command signals having characteristics corresponding to echo-source direction, said receiver including a target-recognition circuit and a gating relay operating, with inherent delay, in response to recognition of each true-target echo signal; a control circuit, including control switch means, adapted to place said control switch means in a condition corresponding to echo-source direction as derived by said control circuit, when operative, from said command signals; means applying said command signals to said control circuit; means controlled by operation of said gating relay, in response to each reception and recognition of a true-target echo signal, to render said control circuit operative to respond to command signals stemming from subsequent echo signals during a predetermined interval, of the order of a few listening periods, following each said reception and recognition of a true-target echo signal; echo-source direction utilization means responsive, when operative, to said control switch means condition; and said gating relay controlling said utilization means to render it operative only upon recognition of a true-target echo signal.

2. In an echo-ranging torpedo wherein spurious and true-target echo signals may be received in the listening periods between repetitive search-pulse transmission instants, in combination: a receiver operative to convert received echo signals to steering command signals having characteristics corresponding to echo-source direction, said receiver including a target-recognition circuit and a gating relay which operates, with inherent delay, in response to recognition of each true-target echo signal; a steering control circuit, including steering relay and switch means, adapted to place said steering relay and switch means in a condition corresponding to echo-source direction as derived by said steering control circuit, when operative, from said steering command signals; means applying said steering command signals to said steering control circuit; means controlled by operation of said gating relay, in response to each reception and recognition of a true-target echo signal, to render said steering control circuit operative to respond to steering command signals stemming from subsequent echo signals during a predetermined interval, of the order of a few listening periods, following each said reception and recognition of a true-target echo signal, and steering apparatus responsive, when rendered effective, to said steering relay and switch means condition; said gating relay, when operated, controlling said steering apparatus to render it effective to respond to said steering relay and switch means condition.

* * * * *